US006536143B2

(12) United States Patent
Lembcke

(10) Patent No.: US 6,536,143 B2
(45) **Date of Patent: *Mar. 25, 2003**

(54) WIDE MULTIPLE-CHAIN TRENCHING MACHINE

(76) Inventor: Joseph P. Lembcke, Miah, Inc. 161 High St. SE. Suite 221, Salem, OR (US) 97301

( * ) Notice: Subject to any disclaimer, the term of this patent is extended or adjusted under 35 U.S.C. 154(b) by 0 days.

This patent is subject to a terminal disclaimer.

(21) Appl. No.: 10/153,304

(22) Filed: May 21, 2002

(65) Prior Publication Data

US 2002/0133985 A1 Sep. 26, 2002

Related U.S. Application Data

(63) Continuation of application No. 10/102,065, filed on Mar. 19, 2002, now abandoned, which is a continuation-in-part of application No. 09/502,402, filed on Feb. 10, 2000, now Pat. No. 6,397,501, application No. 10/153,304, which is a continuation-in-part of application No. 09/502,402.

(60) Provisional application No. 60/119,699, filed on Feb. 11, 1999.

(51) Int. Cl.[7] ..... E02F 5/02

(52) U.S. Cl. ..... 37/465; 37/352; 37/364

(58) Field of Search ..... 37/189, 462, 464, 37/465, 347, 352, 364; 299/75, 34.01, 34.02, 82.1; 405/180, 174

(56) References Cited

U.S. PATENT DOCUMENTS 2,237,773 A * 4/1941 Voorhis et al. ..... 198/307.1
2,650,812 A * 9/1953 Joy ..... 144/72
2,926,896 A * 3/1960 Krekeler ..... 299/78
2,939,692 A * 6/1960 Russell et al. ..... 299/19
3,050,295 A * 8/1962 Osgood ..... 299/64
3,954,301 A * 5/1976 Stepp ..... 299/76
4,194,311 A * 3/1980 Thames ..... 37/300
4,432,584 A * 2/1984 Vartanov et al. ..... 299/25
4,908,967 A * 3/1990 Leece ..... 37/352
5,228,220 A * 7/1993 Bryan, Jr. ..... 37/190
5,471,771 A * 12/1995 Gilbert ..... 241/200
5,497,567 A * 3/1996 Gilbert ..... 299/76
5,601,383 A * 2/1997 Zanin ..... 37/364

* cited by examiner

*Primary Examiner*—Robert E. Pezzuto
*Assistant Examiner*—Kristine Markovich
(74) *Attorney, Agent, or Firm*—David S. Alavi

(57) ABSTRACT

A multiple-chain trenching machine comprises a prime mover with a trenching head assembly operably connected thereto, the head comprising: a) a frame operably connected to the prime mover at a proximal end; b) one or more pairs of proximal and distal primary sprockets mounted on the frame; c) a primary endless-chain digging assembly engaged around each pair of primary sprockets; d) one or more pairs of proximal and distal secondary sprockets mounted on the frame; e) a secondary endless-chain digging assembly engaged around each pair of secondary sprockets. The primary chains are substantially wider than the secondary chains, and trenching head is adapted so that each of the secondary chains produces a relief slot in the leading edge of the trench. The primary chains are driven in a forward chain direction, while the secondary chains may be driven in a forward or a reverse chain direction.

26 Claims, 9 Drawing Sheets

WIDE MULTIPLE-CHAIN TRENCHING MACHINE

RELATED APPLICATIONS

This application is a continuation-in-part of prior-filed non-provisional application Ser. No. 09/502,402 filed Feb. 10, 2000, now U.S. Pat. No. 6,397,501 issued Jun. 4, 2002, which in turn claimed benefit of prior-filed provisional App. No. 60/119,699 filed Feb. 11, 1999. This application is also a continuation of prior-filed non-provisional application Ser. No. 10/102,065 filed Mar. 19, 2002 which is in turn a continuation-in-part of said prior-filed non-provisional application Ser. No. 09/502,402 filed Feb. 10, 2000, now U.S. Pat. No. 6,397,501 issued Jun. 04, 2002. Non-provisional application Ser. No. 09/502,402, non-provisional application Ser. No. 10/102,065, and provisional App. No. 60/119,699 are each hereby incorporated by reference as if fully set forth herein.

FIELD OF THE INVENTION

The field of the present invention relates to chain-type trenching machines. In particular, apparatus and methods are described herein for digging wide trenches with a multiple-chain trenching machine.

BACKGROUND

A wide variety of construction situations require the digging of trenches in rock or other hard earth formations. Chain-type trenching machines are commonly used for this purpose, and several such machines, as well as other types of digging machines, are described in: U.S. Pat. Nos. 5,497,567; 5,471,771; 4,908,967; 4,432,584; 3,954,301; 3,050,295; 2,939,692; 2,926,896; and 2,650,812. Each of these nine patents is hereby incorporated by reference as if fully set forth herein.

It has been observed that while these trenching machines work fairly well for digging relatively narrow trenches (less than about 24 inches wide, for instance), such machines become increasingly inefficient for digging relatively wide trenches (greater than about 36 to 48 inches, for example). Such wide trenches are required to accommodate large buried structures, such as large diameter oil and gas pipelines, for example. In addition, placement of structures within the trench frequently requires that relatively finely divided material (such as sand, gravel, crushed rock, etc.) must be placed in the trench to provide a support bed (also referred to as padding or bedding material) for the structure. This requires an extra step after digging the trench and before placing the structure within the trench, and requires the transportation of the material to and placement within the trench.

It is therefore desirable to provide apparatus and methods for digging wide trenches in rock or other hard earth formations which are more efficient than those currently available. It is also desirable to provide apparatus and methods for digging such trenches in which relatively finely divided material is simultaneously produced and deposited within the trench to provide a support bed for a structure placed within the trench.

SUMMARY

Certain aspects of the present invention may overcome one or more aforementioned drawbacks of the previous art and/or advance the state-of-the-art of trenching apparatus and methods, and in addition may meet one or more of the following objects:

- To provide apparatus and methods for digging wide trenches in rock or other hard earth formations;
- To provide apparatus and methods for digging wide trenches in rock or other hard earth formations by digging at least one relief slot;
- To provide apparatus and methods for digging wide trenches in rock or other hard earth formations using multiple endless-chain digging assemblies;
- To provide apparatus and methods for digging wide trenches in rock or other hard earth formations using multiple endless-chain digging assemblies, wherein two or more secondary endless-chain digging assemblies are operated for cutting relief slots;
- To provide apparatus and methods for digging wide trenches in rock or other hard earth formations using multiple endless-chain digging assemblies, wherein two or more secondary endless-chain digging assemblies are operated for cutting relief slots, and the secondary endless-chain digging assemblies are movable so as to vary the depth of the relief slots during digging of the trench;
- To provide apparatus and methods for digging wide trenches in rock or other hard earth formations using multiple endless-chain digging assemblies, wherein at least one primary endless-chain digging assembly is operated in a forward direction between the secondary digging assemblies for disintegrating and removing material between the relief slots;
- To provide apparatus and methods for digging wide trenches in rock or other hard earth formations using multiple endless-chain digging assemblies, wherein the secondary chains are less than or about equal to the primary chains in width; and
- To provide apparatus and methods for digging wide trenches in rock or other hard earth formations using multiple endless-chain digging assemblies, wherein secondary digging assemblies are operated in a reverse direction for depositing disintegrated material within the trench, the deposited material serving as a support bed for structures subsequently placed within the trench.

One or more of the foregoing objects may be achieved in the present invention by a multiple-chain trenching machine comprising a prime mover with a trenching head assembly operably connected thereto. The trenching head may be raised, lowered, and/or pivoted relative to the prime mover, and comprises: a) a frame having a proximal end operably connected to the prime mover, and a distal end; b) one or more sets of primary sprockets, each set comprising at least one proximal primary sprocket rotatably mounted on the frame and at least one distal primary sprocket rotatably mounted on the frame at the distal end thereof; c) a primary endless-chain digging assembly (hereinafter, "primary chain") engaged with and circulating around each set of primary sprockets and comprising a plurality of pivotably connected links and a plurality of cutting tools substantially rigidly mounted thereon for disintegrating the earth formation; d) one or more sets of secondary sprockets, each set comprising at least one proximal secondary sprocket rotatably mounted on the frame and at least one distal secondary sprocket rotatably mounted on the frame at the distal end thereof; e) a secondary endless-chain digging assembly (hereinafter, "secondary chain") engaged with and circulating around each set of secondary sprockets and comprising a plurality of pivotably connected links and a plurality of cutting tools substantially rigidly mounted thereon for disintegrating the earth formation.

The primary chains may be substantially wider than the secondary chains, and the diameters and positions of the sprockets and/or configuration of the frame may be adapted so that each of the secondary chains cuts more deeply into the ground formation at the leading edge of the trench than the primary chains, thereby producing a relief slot corresponding to each secondary chain. The primary chains are driven in a forward chain direction, so that disintegrated material is removed from the trench by the motion of the primary chains. The secondary chains may be driven in a forward or a reverse chain direction. If operated in the reverse chain direction, the disintegrated material produced by the secondary chains may be deposited within the trench by the motion of the secondary chains. The material thus deposited may serve as a support bed for whatever structure is to be subsequently placed within the trench. The frame and/or secondary sprockets may be provided with an actuation mechanism for moving the secondary chains relative to the primary chains so as to vary the depth of the relief slots during digging of the trench.

One or more of the foregoing objects may be achieved in the present invention by a method for digging wide trenches in rock or other hard earth formations using multiple endless-chain digging assemblies, comprising the steps of: a) positioning a trenching head assembly (as described in the previous paragraph) in the ground formation at the desired depth; b) driving the primary chains in a forward direction; c) driving the secondary chains; d) moving the trenching head assembly in a forward trench-digging direction; and e) conveying, by the forward motion of the primary chains, disintegrated material out of the trench. If the secondary chains are driven in the reverse direction, disintegrated material is deposited within the trench, by the reverse motion of the secondary chains, to serve as a support bed for a structure subsequently placed therein. Reciprocating and/or orbital motion of the secondary chain relative to the primary chain during digging of the trench results in variation of the relief slot depth during digging of the trench.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

Figure 1:
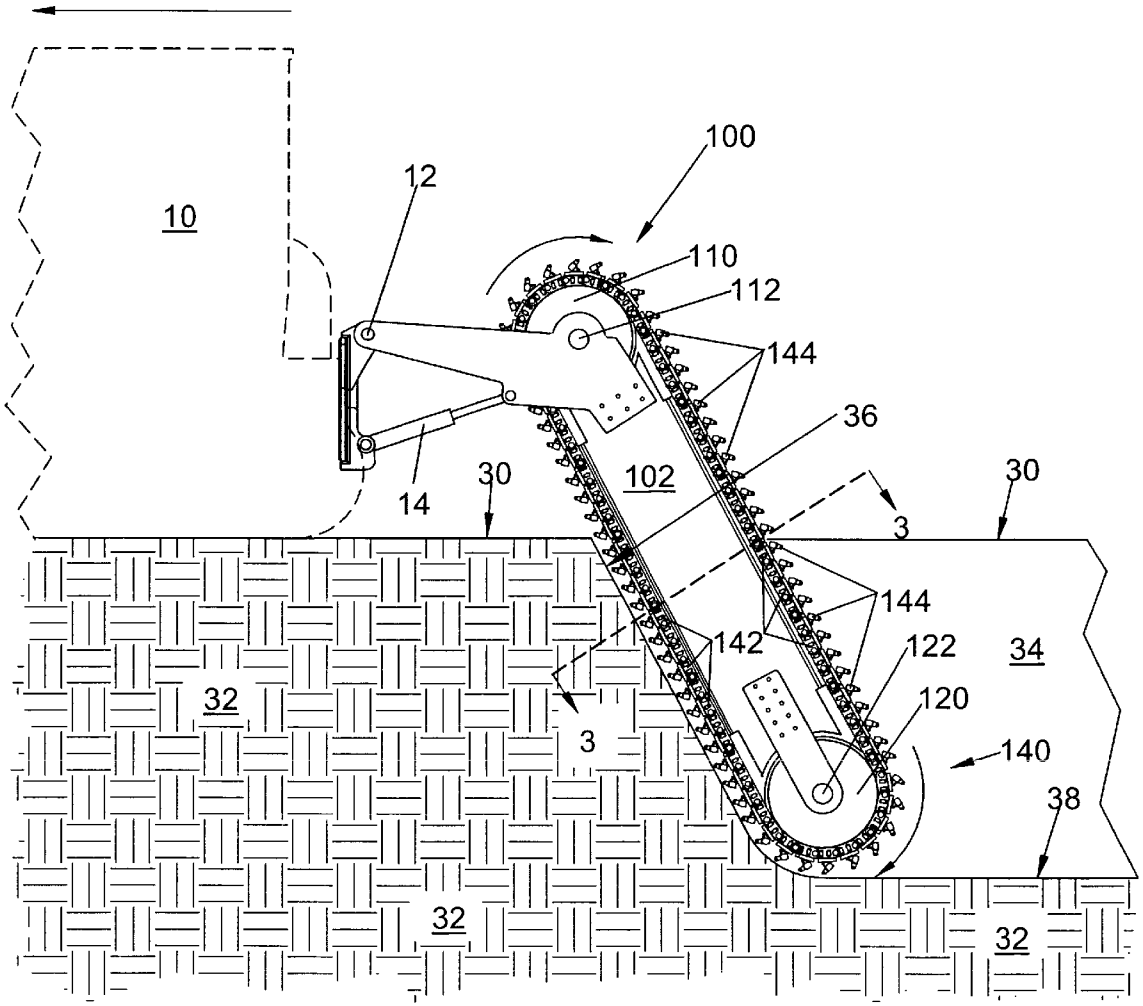
FIG. 1 shows a side view of a trenching machine according to the present invention with a chain being driven in the forward direction.

For purposes of the present written description and/or claims, the word "chain" shall, unless otherwise specified, denote an endless-chain digging assembly comprising a series of pivotably connected links, each of the links engaging corresponding sprockets and/or carrying earth-cutting tools. Each chain typically forms a closed loop following a chain path, the chain path being defined by the sprockets and/or the frame on which the sprockets are rotatably mounted. The chain path typically encompasses the frame and corresponding sprockets, the chain is typically engaged with the sprockets, and the chain may be engaged with the frame as well. Driving of one of the sprockets (a "drive sprocket") typically causes circulating motion of the chain along the corresponding chain path. Many suitable types and configurations of chain links and corresponding sprockets may be employed without departing from inventive concepts disclosed and/or claimed herein. In particular, a roller may be used in place of any non-driven sprocket (an "idler sprocket") while remaining within the scope of inventive concepts disclosed and/or claimed herein, and "sprocket" should be construed in a non-driven position to encompass a roller or other similar idler structure about which a chain may be engaged. Likewise a wide variety of earth cutting tools, or bits, and various combinations and configurations thereof, may be employed without departing from inventive concepts disclosed and/or claimed herein. Some examples of such chain link types and/or configurations, and some examples of such earth-cutting tools and combinations/configurations thereof, are disclosed in the patents incorporated by reference hereinabove.

For purposes of the present written description and/or claims, the phrase "forward trench-digging direction" or "forward direction" when referring to movement of the trenching machine shall denote the direction in which the trench is being dug. The phrase "forward chain direction" or "forward direction" when referring to an endless-chain digging assembly (i.e., chain) shall denoted motion of the chain about the corresponding sprockets so that the portion of the chain in contact with the ground formation being disintegrated moves in the direction that conveys disintegrated material out of the trench. The phrase "reverse chain direction" or "reverse direction" when referring to a chain shall denoted motion of the chain about the corresponding sprockets so that the portion of the chain in contact with the ground formation being disintegrated moves in the direction that deposits disintegrated material within the trench. For example, in the side view of FIG. 1, the forward trench-digging motion of the trenching machine is to the left, while the portion of the trench already dug is to the right. Motion of a chain in a forward chain direction appears clockwise in FIG. 1, with the left portion of the chain (in contact with the ground formation being disintegrated, i.e., the leading edge of the trench) moving upward and conveying disintegrated material out of the trench. Conversely, motion of a chain in a reverse chain direction appears counter-clockwise in FIG. 2, with the left portion of the chain (in contact with the ground formation being disintegrated) moving downward and depositing disintegrated material within the trench.

Figure 2:
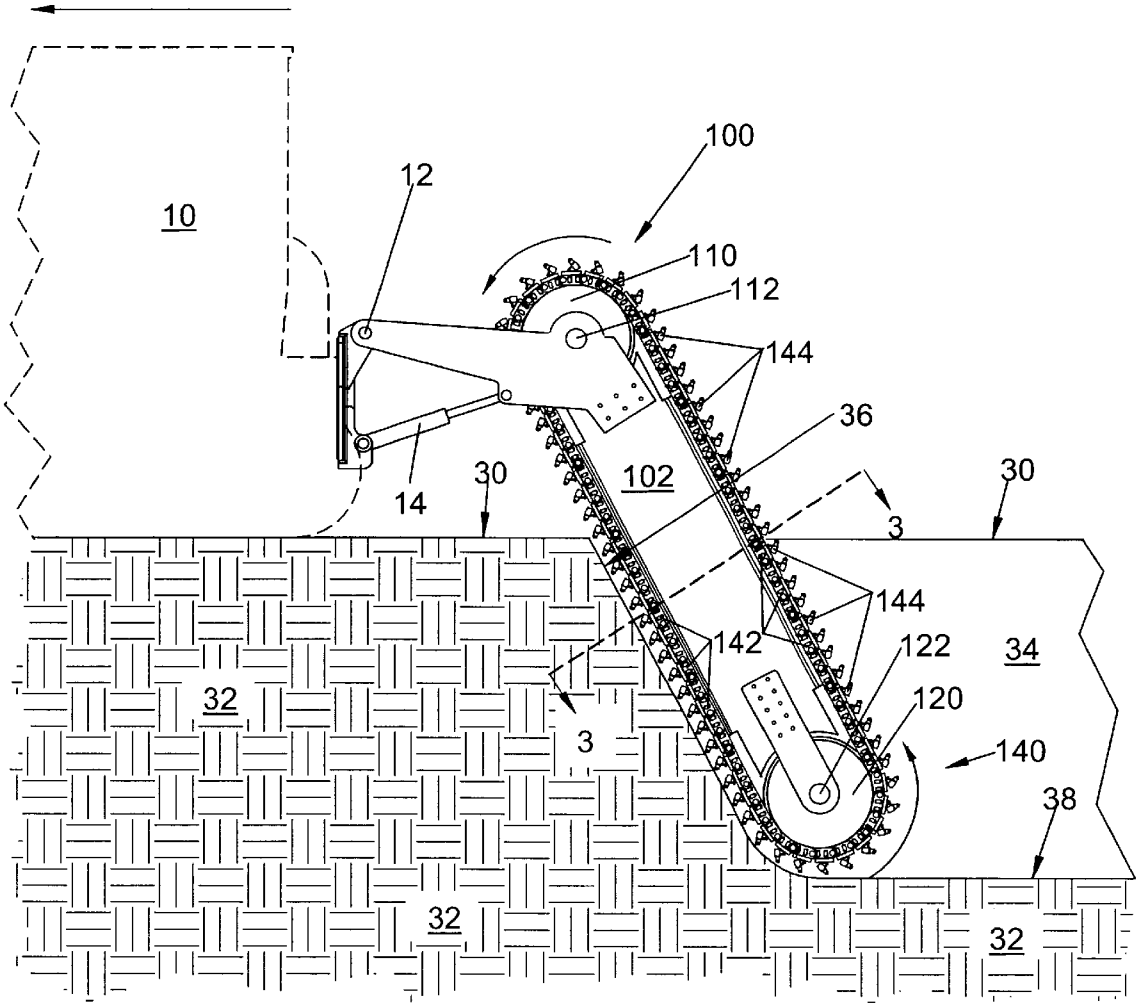
FIG. 2 shows a side view of a trenching machine according to the present invention with a chain being driven in the reverse direction.

FIGS. 1 and 2 show a side view of a trenching machine according to the present invention. Prime mover 10 is shown resting on ground surface 30 with trenching head 100 operably connected thereto. The prime mover may employ crawler treads, wheels, and/or any other suitable means for moving the trenching head along the desired trench path without departing from inventive concepts disclosed and/or claimed herein. Many suitable mechanisms are well known in the art, and some of these are disclosed in the patents incorporated by reference hereinabove. Trenching head 100 is operably connected so that the trenching head may be positioned (relative to the prime mover) to dig a trench of the desired depth below ground surface 30, or alternatively positioned for transportation of the trenching machine. Motions required of the trenching head relative to the prime mover may include, but are not limited to, pivoting in a vertical plane at the proximal end of the trenching head and/or translation of the trenching head along its length. Actuators of any suitable type may be employed to accomplish operable positioning of the trenching head relative to the prime mover without departing from inventive concepts disclosed and/or claimed herein. Many examples of suitable operable positioning and means of actuation thereof are known in the art, and some of these are disclosed in the patents incorporated by reference hereinabove.

As illustrated in FIGS. 1 and 2, trenching head 100 may be pivoted relative to the prime mover 10 about pivot point 12 by hydraulic actuator 14. Trenching head 100 may be pivoted upward to a substantially horizontal position (not shown) for transportation, and may be pivoted downward so that it cuts into a ground surface 30 until reaching a desired trench depth below surface 30. Once a desired trench depth has been reached, prime mover 10 may be employed to move the trenching head in a forward direction to elongate the trench 34 within ground formation 32, by disintegrating and removing material at leading edge 36 of trench 34. Trenching head 100 comprises a frame 102 (also known as a cutter bar) having multiple sets of proximal and distal sprockets rotatably mounted thereon. The distal sprockets may be mounted near the distal end of frame 102, while the proximal sprockets may be mounted at one or more positions on the frame 102, including at the proximal end of frame 102. One such set of proximal sprocket 110 and corresponding distal sprocket 120, mounted on shafts 112 and 122, respectively, is shown in FIGS. 1 and 2. Any other suitable mounting structure may be employed for rotatably mounting sprockets on frame 102 while remaining within the scope of inventive concepts disclosed and/or claimed herein. Chain 140, comprising links 142 with cutting tools 144 mounted thereon, is shown engaged with sprockets 110 and 120 and frame 102 and being driven in a forward direction in FIG. 1, indicated by the arrows (clockwise in FIG. 1). Forward motion of chain 140 results in disintegration of ground formation 32 at leading edge 36 of trench 34. Cutting tools 144 may be suitably adapted (by shape, position, orientation, and so forth) to cut the ground formation and convey disintegrated material out of the trench when chain 140 is driven in the forward chain direction. The disintegrated material is conveyed upward by the upward motion of the portion of chain 140 in contact with trench leading edge 36. The upwardly conveyed material leaves the trench in front of trenching head and may be collected by any suitable means without departing from inventive concepts disclosed and/or claimed herein.

Chain 140 is shown being driven in the reverse chain direction in FIG. 2, indicated by the arrows (counterclockwise in FIG. 2). Reverse motion of chain 140 results in disintegration of ground formation 32 at leading edge 36 of trench 34. The disintegrated material is conveyed downward by the downward motion of the portion of chain 140 in contact with trench leading edge 36. Cutting tools 144 may be suitably adapted (by shape, position, orientation, and so forth) to cut the ground formation and deposit disintegrated material within the trench when chain 140 is driven in the reverse chain direction. The downwardly conveyed material is deposited on bottom 38 of trench 34. Disintegrated material thus deposited my serve as a support bed for any structures or objects subsequently placed within the trench, such as pipelines or conduits. Earth-digging tools 144 may be positioned, aligned, and/or otherwise configured on chain 140 in any of a variety of appropriate manners depending on the direction of travel of chain 140, i.e. for upwardly conveying disintegrated material when mounted on a forward-driven chain, or for downwardly conveying disintegrated material when mounted on a reverse-driven chain.

Figure 3:
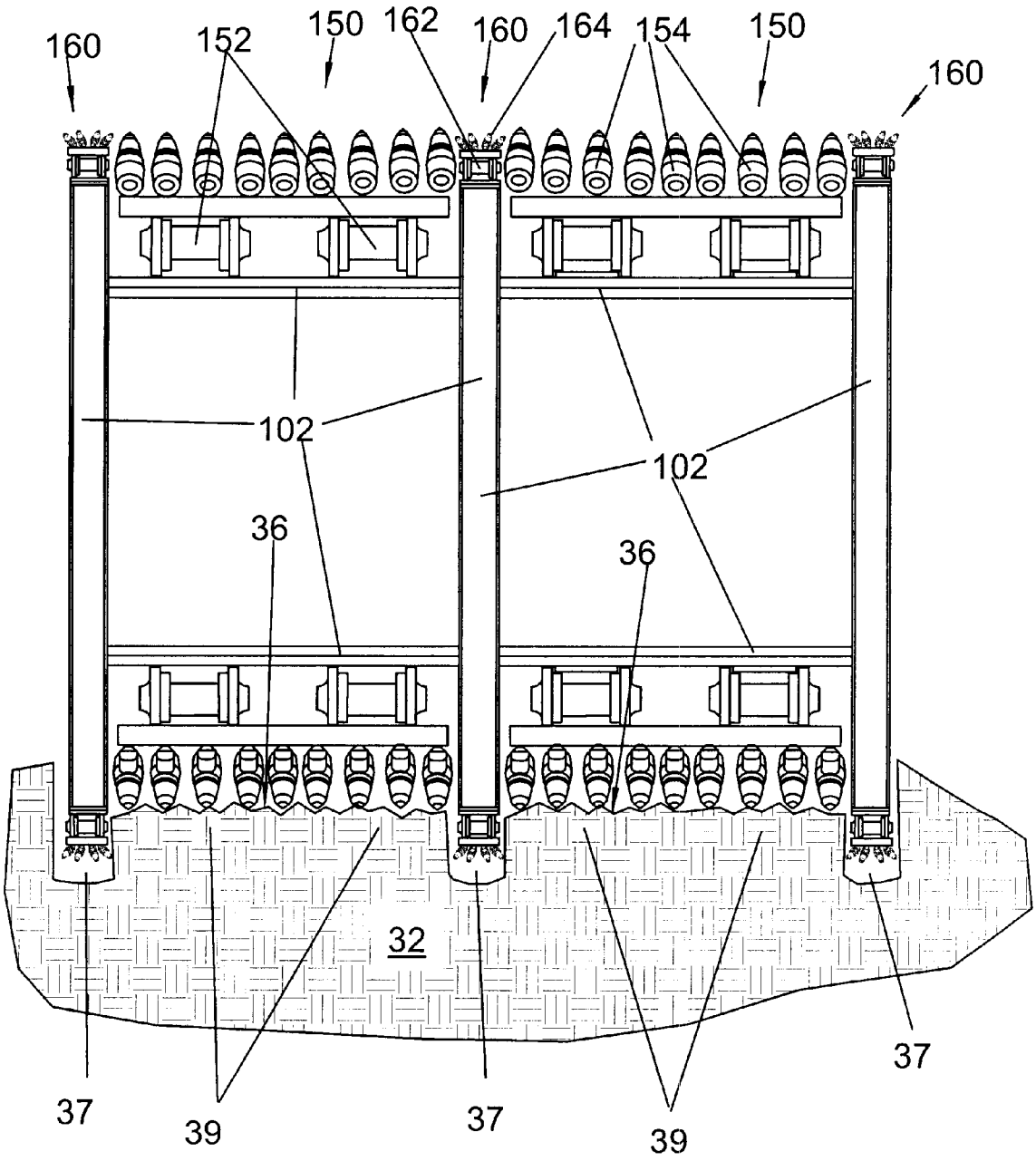
FIG. 3 shows a cross-section of a trenching head according to the present invention.

FIG. 3 shows a cross section of trenching head 100. One or more primary chains 150 are shown, as well as multiple secondary chains 160, each moving about frame 102 engaged therewith and with corresponding sprockets (not shown). Each of primary chains 150, if viewed from the side, appears as generally depicted in FIG. 1, comprising links 152 and earth-cutting tools 154 and moving about its corresponding sprockets in a forward chain direction. Primary chains 150 therefore disintegrate the ground formation 32 at trench leading edge 36 and convey the disintegrated material upward and out of the trench. Each of secondary chains 160, comprising links 162 and earth-cutting tools 164, may appear as generally depicted in FIG. 2, moving about its corresponding sprockets in a reverse chain direction, disintegrating the ground formation 32 at trench leading edge 36, and conveying the disintegrated material downward and depositing the material on the bottom of the trench. Alternatively, each of secondary chains 160 may appear as generally depicted in FIG. 1, moving in a forward chain direction and operating similarly to primary chains 150. Secondary chains may be provided at the sides of trenching head, as well as between primary chains 150.

In a preferred embodiment of the present invention, primary chains 150 may be between about 12 inches and about 24 inches wide, preferably about 18 inches wide and move at a linear velocity between about 200 feet/minute and about 400 feet/minute, preferably about 300 feet/minute. Secondary chains 160 may be between about 1 inch wide and about 6 inches wide, preferably about 3 inches wide, and move at a linear velocity of between about 200 feet/minute and about 2500 feet/minute, preferably about 1200 feet/minute. Note that the chain widths refer to the size of the resulting cut in the ground formation, which, depending on the positioning/alignment of the earth-cutting tools, may be wider than the actual width of the links of the chain. Earth-cutting tools 164 on secondary chains 160 may be smaller than earth-cutting tools on primary chains 150, although any combination of relative tool sizes may be employed without departing from inventive concepts disclosed and/or claimed herein.

The combination of relatively wider chain, relatively slower velocity, and/or relatively larger earth-cutting tools may render primary chains 150 relatively more suitable for disintegrating and conveying relatively large amounts of relatively coarsely divided material out of the trench. The combination of relatively narrower chain, relatively faster velocity, and/or relatively smaller earth-cutting tools may render secondary chains 160 relatively more suitable for disintegrating and depositing relatively small amounts of relatively finely divided material on the bottom of the trench. The coarsely divided material may be more easily removed from the trenching site and disposed of, while the more finely divided material may be more suitable as a support bed material. In addition to producing support bed material, driving primary chains and secondary chains in opposite directions may also serve to reduce vibrations during operation of the trenching machine, since forces arising from engagement of the primary and secondary chains with the ground formation will tend to partially counter-balance one another.

Figure 4:
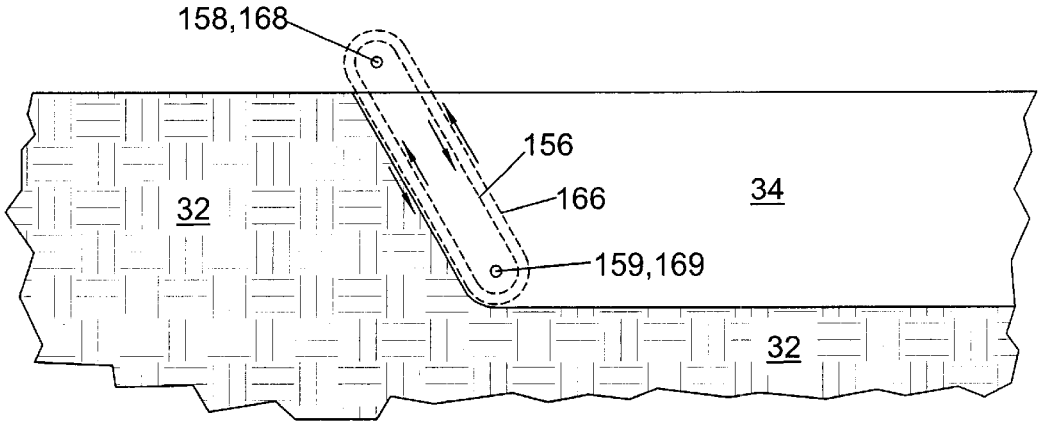
FIG. 4 shows a schematic side view of primary and secondary chain paths for a trenching head according to the present invention.
Figure 5:
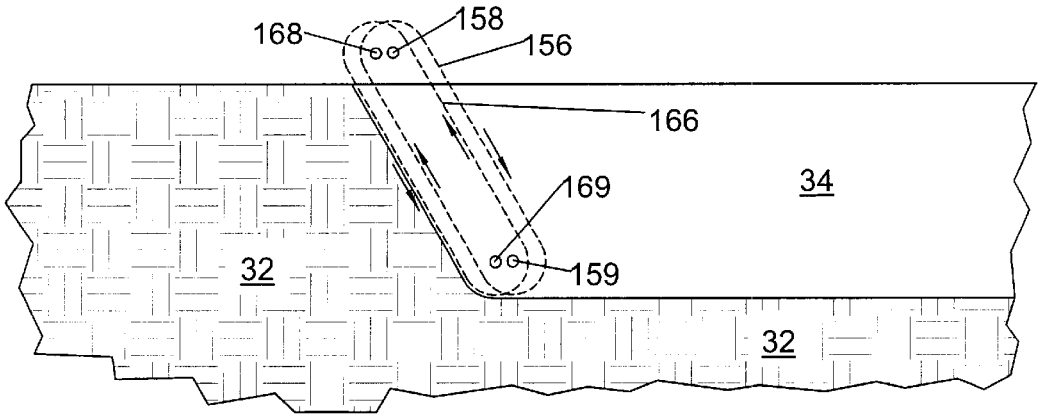
FIG. 5 shows a schematic side view of primary and secondary chain paths for a trenching head according to the present invention.

In a preferred embodiment of the present invention, frame 102 and/or sprockets for secondary chains 160 may be sized and/or positioned so that a portion of secondary chain path 166 followed by secondary chains 160 may extend farther toward the leading edge of the trench than primary chain path 156 followed by primary chains 150, as shown in FIG. 3 and schematically in FIGS. 4 and 5. This results in a narrow relief slot 37 being cut by each secondary chain 160. The projecting cores 39 of ground formation 32 thus produced between pairs of relief slots 37 may be more readily removed by primary chains 150, since presence of the relief slots 37 may decrease lateral support of cores 39. Many configurations of primary chain path 156 and secondary chain path 166 may be employed without departing from inventive concepts disclosed and/or claimed herein, and may be achieved by a variety of sizes, positions, and/or configurations of the frame and sprockets. In the exemplary configuration shown schematically in FIG. 4, primary sprockets and larger concentric secondary sprockets mounted on common distal and proximal shafts 158/168 and 159/169, respectively, would result in relief cuts in both the leading edge and the bottom of trench 34. In the exemplary embodiment of FIG. 5, primary and secondary proximal shafts 158/168 may be offset and/or primary and secondary distal shafts 159/169 may be offset so that at least a portion of secondary chain path 166 extends farther toward the leading edge of the trench than primary chain path 156, resulting in relief cuts in the leading edge of trench 34, while chain paths 156 and 166 may be made substantially tangent to a common substantially horizontal plane so that no relief cut is made in the bottom of the trench. Other configurations of frame and sprockets may be equivalently employed.

Figure 8:
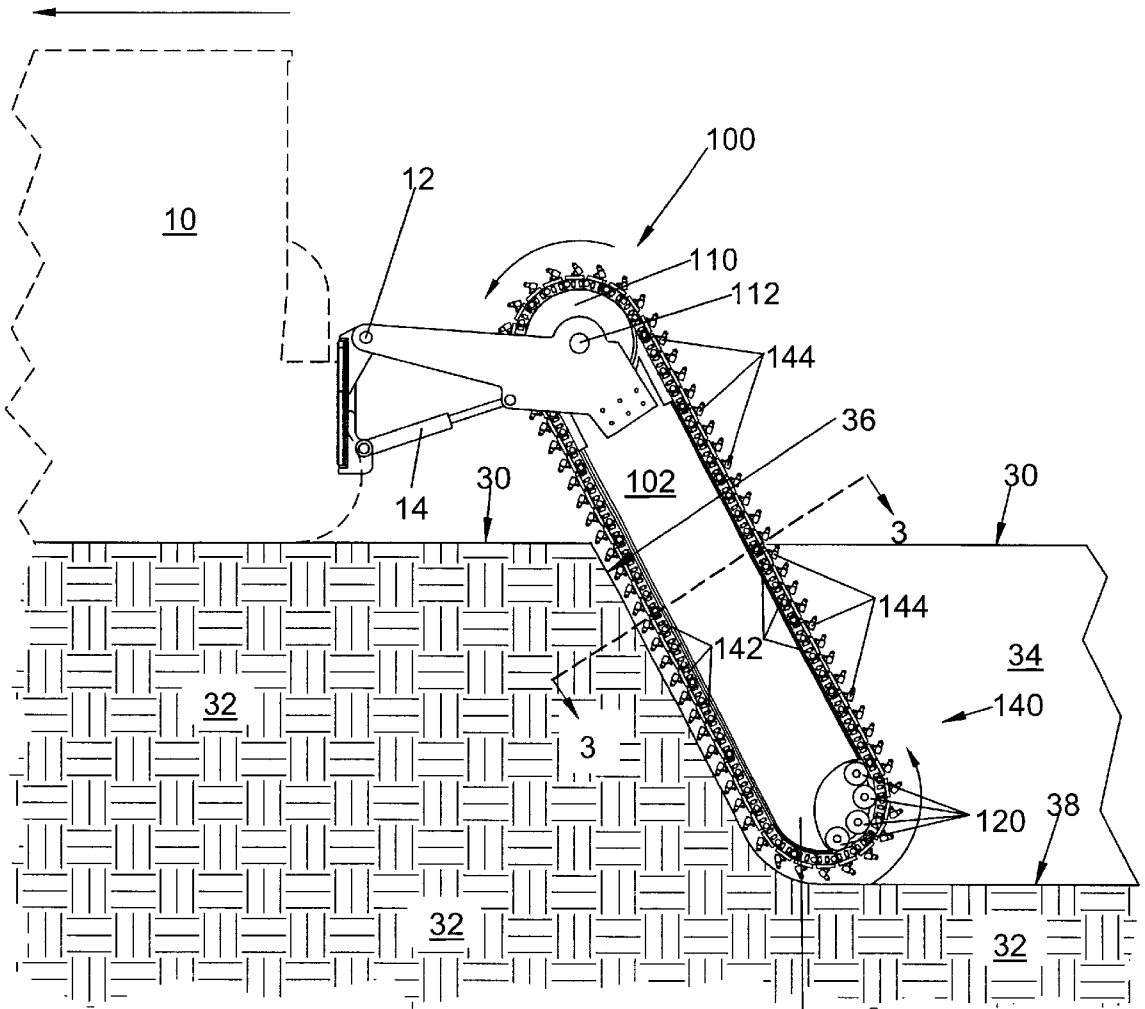
FIG. 8 shows a side view of a trenching machine according to the present invention.

In the exemplary embodiment of FIG. 8, a portion 102*a* of frame 102 defines a portion of the portion of the secondary chain path that extends toward the leading edge of the trench beyond primary chain path. This may be contrasted to the embodiments shown in FIGS. 1 and 2, wherein the chain path is substantially defined by only the positions and diameters of the sprockets (although the frame may nevertheless support the chain along a portion of the chain path). The exemplary embodiment of FIG. 8 also illustrates the use of multiple distal secondary sprockets 120 to determine a portion of secondary chain path.

Figure 9:
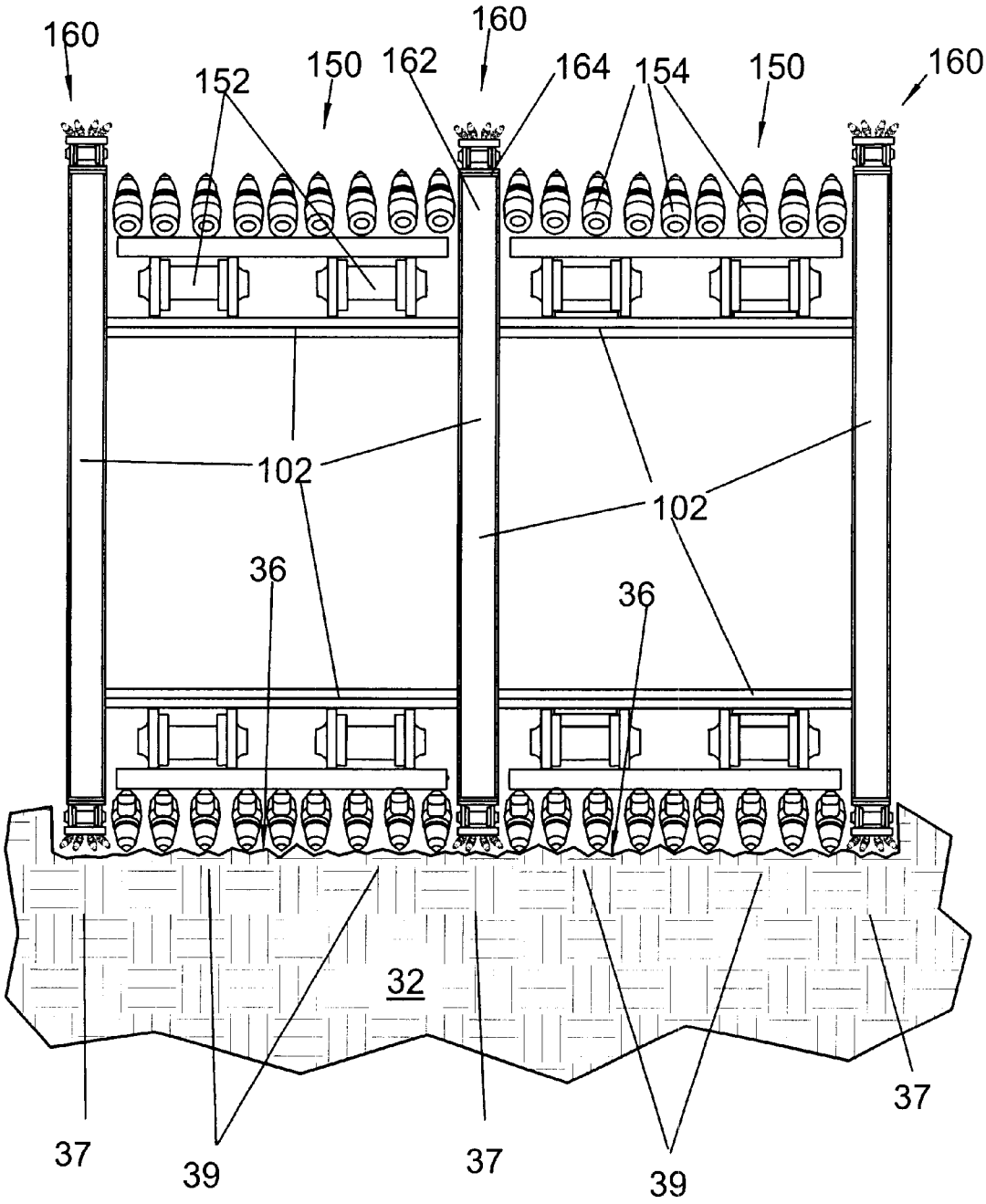
FIG. 9 shows a cross-section of a trenching head according to the present invention.

In an alternative embodiment of the present invention, the frame and/or sprockets my be provided with one or more actuation mechanisms for moving the secondary chain path relative to the primary chain path during digging of the trench. In this way, the depth of the relief slots also varies during digging of the trench. This results in more focused application of drive power to the primary or secondary chains as the chain paths move relative to one another and alternately engage the leading edge of the trench. For example, the secondary chains may be extended toward the leading edge of the trench so as to cut a relief slot of a maximum operational depth, as illustrated in FIG. 3. In this configuration, the secondary chains may more heavily engage the leading edge of the trench than the primary chains, and a majority of the drive power applied to the chains would drive the secondary chains. The secondary chains may then be withdrawn from the leading edge of the trench (as shown in FIG. 9), thereby allowing the primary chains to more heavily engage the leading edge of the trench. A majority of the applied drive power would now go to drive the primary chains as they disintegrate the protruding cores between the relief slots. By repeatedly extending and withdrawing the secondary chains in this way during digging of the trench, smaller total drive power may be employed for driving the trenching head, since that drive power may be alternately applied to digging the relief slots or disintegrating the cores. The actuation mechanism may be implemented in any of a variety of suitable ways, including (but not limited to) pistons, cams, gears, hydraulics, and so on, for example. The motion of the secondary chains relative to the primary chains may be reciprocating, orbital, or any other suitable type of motion resulting in the desired repeated extension and withdrawal of the secondary chains at the leading edge of the trench. The actuation may involve movements of one or more secondary sprockets and/or movement of portions of the frame that support/guide a portion of the secondary chain path. A substantially similar result may be obtained by moving the primary chain path, or both primary and secondary chain paths.

Figure 6:
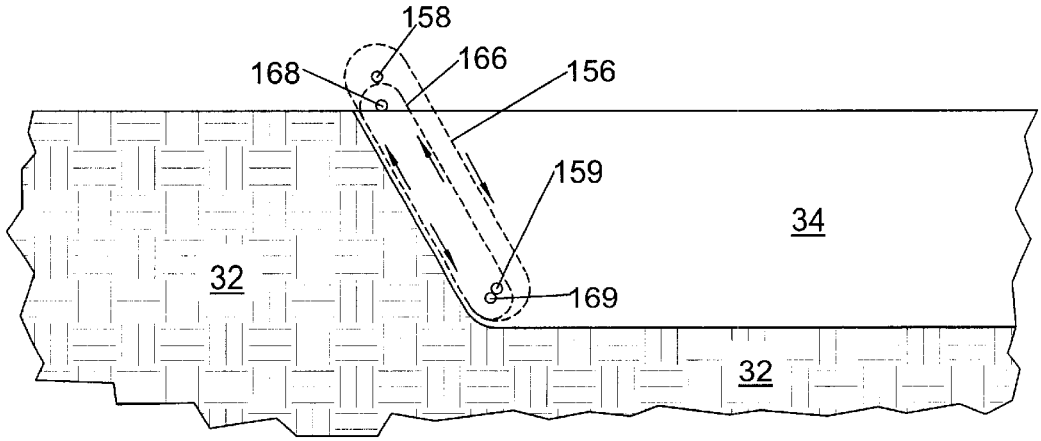
FIG. 6 shows a schematic side view of primary and secondary chain paths for a trenching head according to the present invention.

In any embodiment in which secondary chains move along a secondary chain path configured to produce relief cuts, secondary chains may be propelled around path 166 in a forward or a reverse direction, depending on whether deposition of disintegrated material within the trench is desirable. If such deposition is desirable, secondary chains may be driven in a reverse direction (shown in FIGS. 4 and 5). If no deposition is desired, secondary chains may be driven in a forward direction (not shown). If deposition is desired but relief slots are not desired, the exemplary embodiment of FIG. 6 may be employed, in which chain paths 156 and 166 substantially coincide at the leading edge of the trench and are substantially tangent to a substantially horizontal plane while primary and secondary chains are driven in opposite directions (primary driven in the forward direction, secondary driven in the reverse direction). An embodiment having substantially identical primary and secondary chain paths 156 and 166 with primary and secondary chains driven in opposing directions (not shown) may be employed to deposit disintegrated material within the trench without producing relief cuts.

Without departing from inventive concepts disclosed and/or claimed herein, any number and position of shafts or other structures for rotatably mounting the sprockets on the frame, any accompanying combinations of sprocket diameters (primary, secondary, proximal, distal), and/or any configuration for the frame may be employed to implement the present invention. In particular, primary chains 150 need not all follow the same path 156, but each primary chain may follow its own path. Similarly, secondary chains 160 need not all follow the same path 166, but each secondary chain may follow its own path.

Any suitable drive mechanism may be used to energize a chain, either directly or via a drive sprocket, including as examples, but not limited to: gears, belts, drive chains, transmissions, drive shafts, differential drives, hydraulic motors, combinations thereof, and/or functional equivalents thereof. A drive sprocket may be driven directly independently of its respective shaft or other mounting structure, or may be journaled to rotate with its respective shaft, which in turn may be driven. Without departing from inventive concepts disclosed and/or claimed herein, any suitable coupling scheme may be employed to connect a drive mechanism to a drive sprockets. Many examples of suitable drive mechanisms and coupling schemes are known in the art, and some of these are disclosed in the patents incorporated by reference hereinabove. While the proximal sprocket may typically serve as the drive sprocket, it may be desirable for the distal sprocket to serve as the drive sprocket for secondary chains driven in the reverse chain direction, so that the portion of the chain in contact with the leading edge of the trench is under tension. Without departing from inventive concepts disclosed and/or claimed herein, a roller or other similar idler structure may be equivalently employed in place of any sprocket that is not driven, and such rollers or other structures shall be construed to fall under the term "sprocket" when used to describe any non-driven sprocket.

Frame 102 typically includes a mechanism for properly tensioning the chains engaged with the sprockets. As the trenching head assembly is used and heats up, expansion of the chains necessitates implementation of a dynamic tensioning mechanism for maintaining proper chain tensioning during digging of the trench. This is typically accomplished using springs, hydraulics, or other similar actuators for altering the length of the chain path to compensate for changes in chain length/tension. In the context of the present invention, dynamic tensioning is complicated by the fact that the primary and secondary chains will typically expand by differing amounts, thereby requiring differing re-tensioning adjustments. Accordingly, an alternative embodiment of the present invention includes independent dynamic re-tensioning for the primary and secondary chains. These may be provided as an individual re-tensioning mechanism for each chain (primary or secondary), one re-tensioning mechanism for all primary chains and one re-tensioning mechanism for all secondary chains, or multiple re-tensioning mechanisms with each mechanism re-tensioning some subset of the primary or secondary chains.

Figure 7:
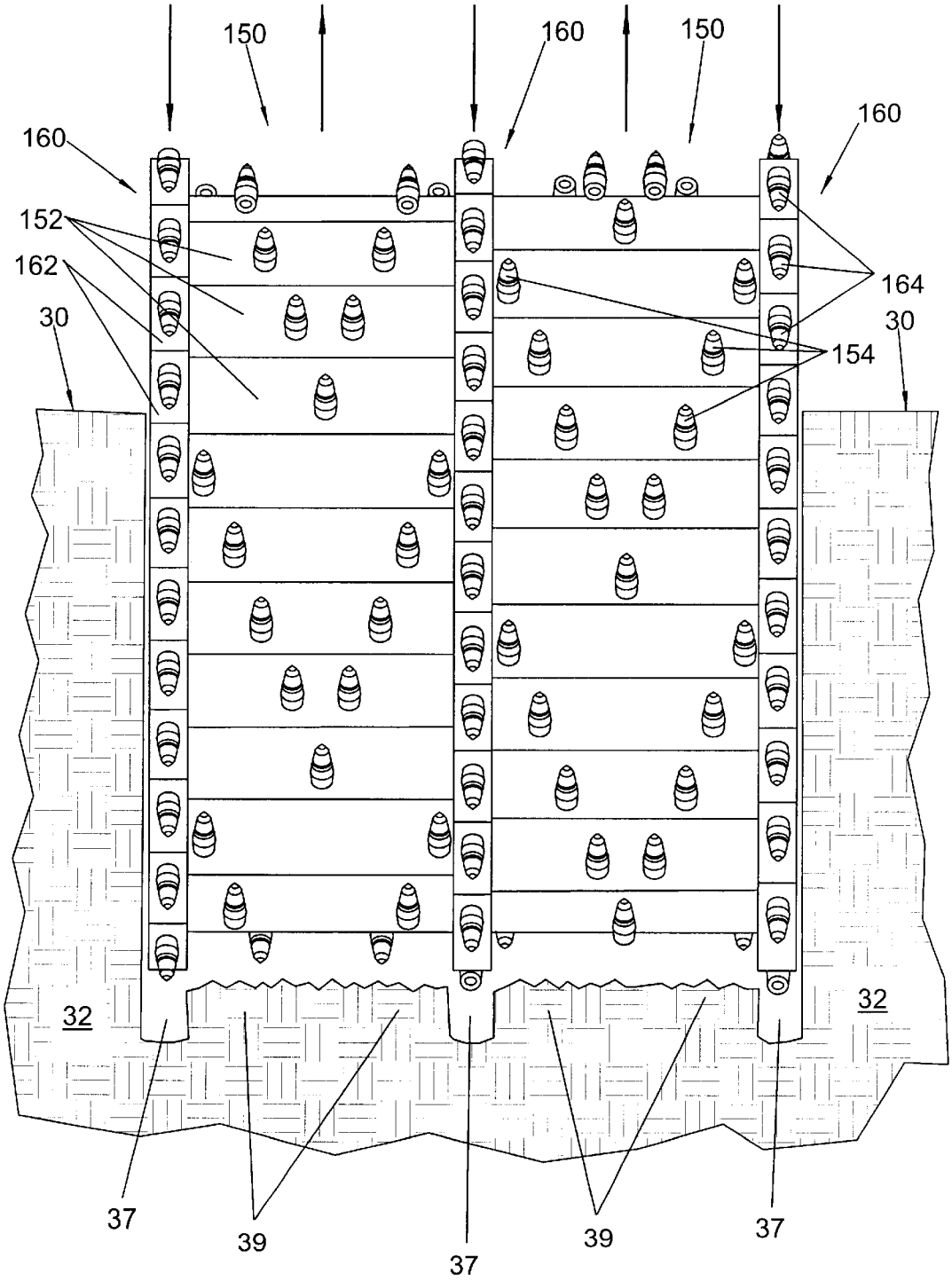
FIG. 7 shows a front view of a trenching head according to the present invention.

Without departing from inventive concepts disclosed and/or claimed herein, various arrangements of earth-cutting tools 154 made be employed on primary chains 150 to take advantage of the presence of relief slots 37 for disintegration and removal of cores 39. In the example shown in FIG. 7, trenching head 100 is viewed from the leading edge 36 of trench 34. Secondary chains 160 are shown being driven in the reverse direction, cutting relief slots 37, and producing cores 39. Earth-cutting tools 154 are arranged on primary chain 150 in a staggered "V" pattern, with the outermost tools (the top of the "V") leading the innermost tool (the bottom of the "V") as chain 150 travels upward against the leading edge 36 of the trench. The leading, outermost earth-cutting tools hit core 39 at its edge, where it is weakest and may be most readily disintegrated. Removal of the edge portion of core 39 then weakens the next portion inward from the edge, which is struck and disintegrated by the next earth-cutting tool on chain 150, which is displaced inwardly from the first tool. This pattern of disintegration of outermost remaining portions of core 39 continues from both sides until the center earth-cutting tool (the bottom of the "V") strikes and disintegrates the center (and only remaining) portion of core 39. This cycle is repeated as secondary chains continuously deepen relief slots 37 and cores 39 are disintegrated and removed from their outer edges inward.

Figure 10:
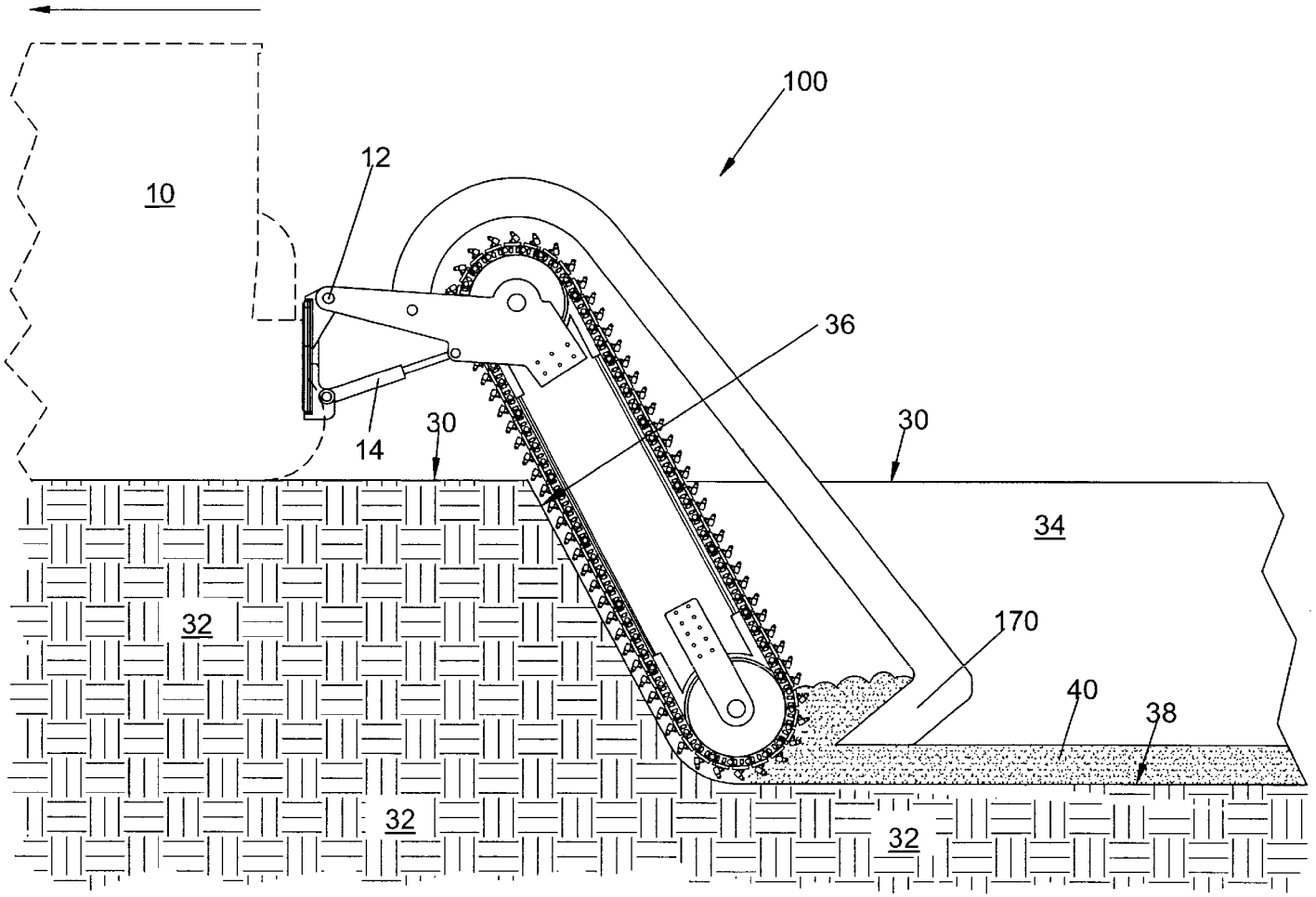
FIG. 10 shows a side view of a trenching machine according to the present invention.
Figure 11:
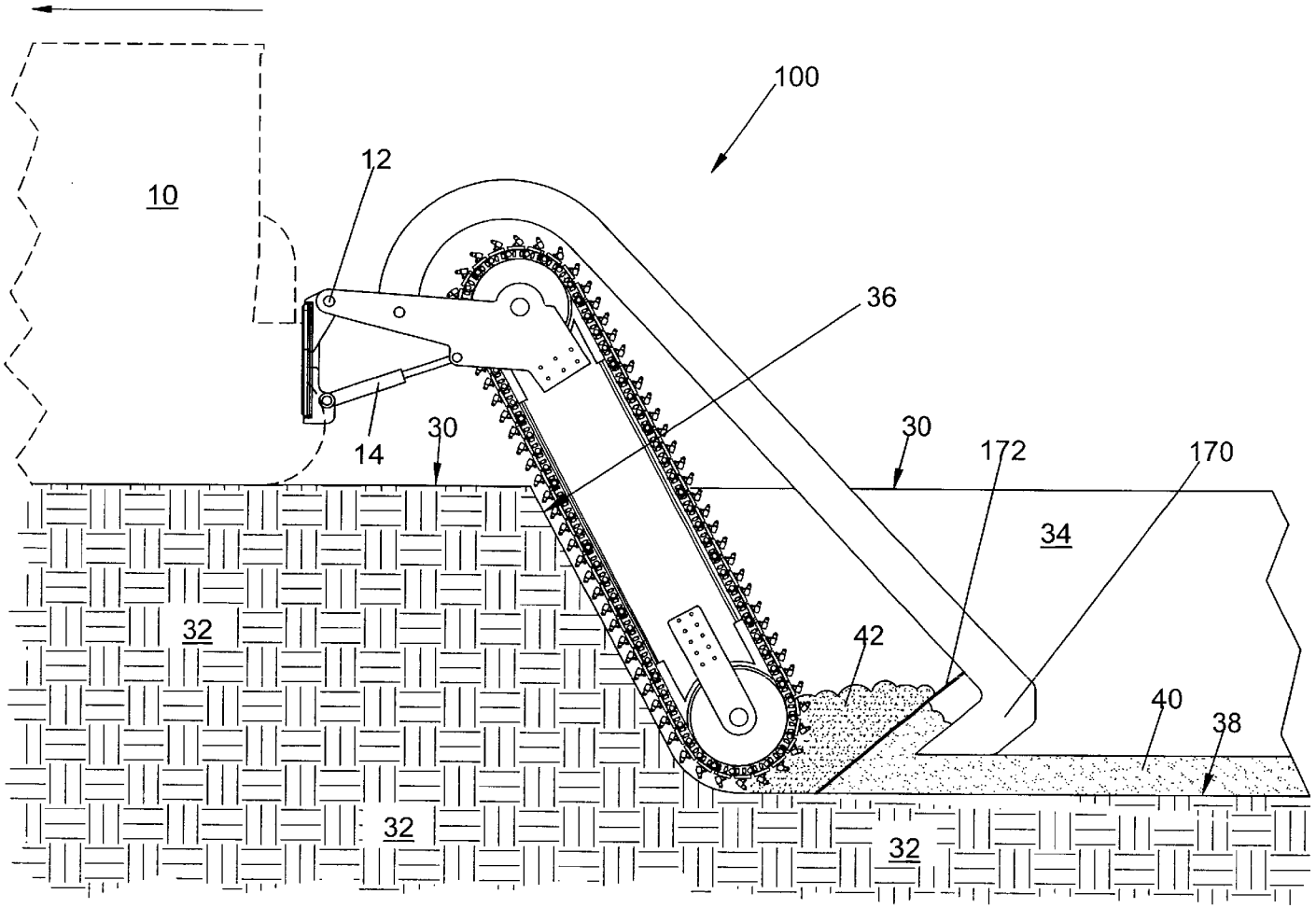
FIG. 11 shows a side view of a trenching machine according to the present invention.

In prior trench-digging systems, a crumbing shoe is often employed, trailing the trenching head within the trench, in order to clear the bottom of a trench of debris as the trench is dug. The crumbing shoe pushes disintegrated material left in the trench forward into the trenching head, where forward motion of the chains conveys the material upward and out of the trench. In the present invention, one or more chains may be operated in a reverse chain direction in order to deposit disintegrated material in the trench to form a support bed. In this instance the crumbing shoe may be omitted, or may be suitably adapted to leave disintegrated material in the trench. Examples of such suitable adaptations are shown in FIGS. 10 and 11. In the embodiment of FIG. 10, crumbing shoe 170 trails trenching head 100 within trench 34. One or more chains of trenching head 100 are operated in the reverse direction to deposit disintegrated material in the trench. Crumbing shoe 170 is set at a desired height to determine the depth of the support bed material 40 left within the trench. Any disintegrated material projecting above the desired support bed depth is pushed forward into trenching head 100, where forward-moving chains convey the material upward and out of the trench. Disintegrated material below the crumbing shoe 170 remains to form a support bed 40 of the desired depth.

In FIG. 11, a screen 172 moves along the bottom 38 of the trench 34 ahead of the crumbing shoe 170. The mesh of screen 172 is chosen to allow therethrough only fragments of disintegrated material below a maximum size. In this way only more finely divided material will remain in the trench to form support bed 40. Coarser material 42 is pushed forward by screen 172 into the trenching head 100, where forward-moving chains convey the coarser material upward and out of the trench. Crumbing shoe 170 is set at a desired height above the trench bottom 38 to form a support bed 40 of the desired depth. More finely divided material may be deemed more desirable as a support bed material than more coarsely divided material.

In the embodiments of FIGS. 10 and 11, any suitable configuration may be employed for supporting crumbing shoe 170 (and screen 172 if present) at the desired height and moving the same through the trench behind the trenching head. Crumbing shoe 170 may be coupled to and moved by prime mover 10, or a separate mover may be provided for moving crumbing shoe 170. Any suitable wheels, skids, bearings, or other mechanism may be employed for supporting crumbing shoe 170 at the desired height above trench bottom 38. A suitable mechanism may support the crumbing shoe from the ground surface 30, on the trench bottom 38, and/or from the sides of trench 34. Crumbing shoe 170 may be configured with a substantially flat substantially horizontal lower portion to provide a substantially flat substantially horizontal support bed. Alternatively, the lower portion of crumbing shoe 170 may be adapted to yield a support bed having any desired shape. For example, if the trench is intended to receive a single substantially cylindrical structure (a pipeline, for example), then a concave support bed may be more suitable than a flat support bed, and the lower surface of crumbing shoe 170 may be adapted accordingly. If multiple structures are to be laid in the trench, a longitudinally "corrugated" support bed may be advantageous, and the bottom portion of the crumbing shoe maybe suitably adapted to yield such a support bed structure.

A preferred method for digging wide trenches in rock or other hard earth formations using multiple endless-chain digging assemblies according to the present invention comprises the steps of: a) positioning a trenching head assembly 100 (as described hereinabove in its preferred and alternative embodiments) in a ground formation 32 at the desired depth; b) driving primary chains 150 in a forward chain direction; c) driving secondary chains 160 at about one to eight times the linear velocity of primary chains 150; d) moving trenching head assembly 100 in a forward trench-digging direction; e) conveying, by the forward motion of primary chains 150, disintegrated material out of trench 34. If the secondary chains are driven in the reverse chain direction, the additional steps may be employed of: f) depositing, by the reverse motion of secondary chains 160, disintegrated material on trench bottom 38; and g) forming the disintegrated material deposited within the trench into a support bed for a structure subsequently placed within the trench.

In an alternative method according to the present invention, relief slots and the trench may be dug sequentially using multiple trenching head assemblies, instead of concurrently with a single trenching head assembly as disclosed hereinabove. An alternative method according to the present invention includes the steps of: digging a relief a lot along a trench path with a slot-cutting trenching head; and after digging the relief slot, digging the trench along the trench path with a trench-cutting trenching head. The trench-cutting trenching head is substantially wider than the slot-cutting trenching head, and the trench substantially encompasses the relief slot. The relief slot may typically be more readily dug than a wide trench, and the presence of the relief slot facilitates digging of the wide trench in a manner similar to that described above. A slot-cutting trenching head may be used repeatedly to cut multiple relief slots prior to digging the trench with the trench-cutting trenching head.

When digging a trench in softer earth formations, it may be the case that the sides of the trench cave in after the trenching head passes through. In some case this is not undesirable, for example when a structure (pipe, cable, and so forth) is laid in the trench concurrently with digging. However, if the collapsing material falls on the top of any forward-driven chains of the trenching head, then some of that material will be drawn under the lower end of the trenching head and conveyed up the leading edge of the trench and out of the trench. Accordingly, the sprockets and/or frame of the trenching head may be adapted so that the upper (i.e., trailing) portion of the chain paths are narrower than the lower portion (i.e., leading portion) of the chain path. In this way the trailing portions of the chains do not scrape against the sides of the trench and prematurely cause caving-in of the sides. Additionally, a shroud or cowling may be provided over the chains to deflect collapsing material from the trench sides away from the chains, so that the material remains in the trench and is not drawn under the trenching head and conveyed out of the trench.

The present invention has been set forth in the forms of its preferred and alternative embodiments. It is nevertheless intended that modifications to the disclosed multiple-chain trenching apparatus and methods may be made without departing from inventive concepts disclosed and/or claimed herein.

What is claimed is:

1. A method for digging a trench in a hard earth formation, comprising the steps of:

positioning a multiple-chain trenching head assembly in the earth formation at a desired trench depth below a ground surface, the trenching head assembly comprising a frame having a proximal end adapted for operably connecting to a prime mover positioned on the ground surface and thereby enabling positioning of the trenching head within the trench below the ground surface, a set of primary sprockets, the set comprising at least one proximal primary sprocket rotatably mounted on the frame and at least one distal primary sprocket rotatably mounted on the frame at a distal end thereof, at least one of the frame and the set of primary sprockets defining a primary chain path, a primary chain engaged with and circulating around the set of primary sprockets and comprising a plurality of pivotably connected links and a plurality of cutting tools substantially rigidly mounted thereon for disintegrating the earth formation, a set of secondary sprockets, the set comprising at least one proximal secondary sprocket rotatably mounted on the frame and at least one distal secondary sprocket rotatably mounted on the frame at the distal end thereof, at least one of the frame and the set of secondary sprockets defining a secondary chain path, and a secondary chain engaged with and circulating around the set of secondary sprockets and comprising a plurality of pivotably connected links and a plurality of cutting tools substantially rigidly mounted thereon for disintegrating the earth formation;

driving the primary chain at a primary chain linear drive speed in a forward chain direction along the primary chain path, thereby disintegrating material at a leading edge of the trench and conveying disintegrated material upward and out of the trench;

driving the secondary chain at a secondary chain linear drive speed along the secondary chain path, thereby disintegrating material from the leading edge of the trench; and moving the trenching head assembly in a forward trench-digging direction, at least one of the frame, the set of primary sprockets, and the set of secondary sprockets being adapted so that at least a portion of the secondary chain path extends farther toward the leading edge of the trench than the primary chain path, so that disintegration of material by the secondary chain produces a relief slot in the leading edge of the trench.

2. The method of claim 1, the secondary chain being no wider than about the width of the primary chain.

3. The method of claim 1, the secondary chain being narrower than the width of the primary chain.

4. The method of claim 1, an axis of the distal secondary sprocket being offset from an axis of the distal primary sprocket so that at least a portion of the secondary chain path extends farther toward the leading edge of the trench than the primary chain path.

5. The method of claim 1, an axis of the proximal secondary sprocket being offset from an axis of the proximal primary sprocket and an axis of the distal secondary sprocket being offset from an axis of the distal primary sprocket so that at least a portion of the secondary chain path extends farther toward the leading edge of the trench than the primary chain path.

6. The method of claim 1, the frame defining at least a portion of the secondary chain path extending farther toward the leading edge of the trench than the primary chain path.

7. The method of claim 1, the trenching head assembly further including multiple distal secondary sprockets rotatably mounted near the distal end of the frame for defining a portion of the secondary chain path.

8. The method of claim 1, the secondary chain being driven in a reverse chain direction around the secondary chain path, thereby conveying disintegrated material downward and depositing the disintegrated material within the trench.

9. The method of claim 8, further including the steps of:

positioning a crumbing shoe in the trench behind the trenching head assembly at a pre-determined depth below the ground surface;

moving the crumbing shoe in the forward trench-digging direction behind the trenching head assembly, the crumbing shoe being adapted for pushing disintegrated material that projects above a desired support bed surface forward toward the trenching head assembly, the crumbing shoe being adapted for leaving disintegrated material that lies below the desired support bed surface in the trench to form a support bed.

10. The method of claim 9, further including the steps of:

positioning a screen in the trench between the trenching head assembly and the crumbing shoe;

moving the screen in the forward trench-digging direction behind the trenching head assembly and ahead of the crumbing shoe, the screen being adapted for pushing disintegrated material fragments above a desired mesh size forward toward the trenching head assembly, the screen being adapted for leaving disintegrated material fragments below the desired mesh size in the trench to form a support bed.

11. The method of claim 1, at least one of the frame, the distal primary sprocket, and the distal secondary sprocket being adapted so as to define distal portions of the primary and secondary chain paths substantially tangent to a common substantially horizontal plane, so that disintegration of material by the primary and secondary chains yields a substantially flat bottom surface of the trench.

12. The method of claim 1, further including the step of moving the secondary chain path relative to the primary chain path while driving the primary and secondary chains, thereby varying the depth of the relief slot in the leading edge of the trench, the trenching head assembly being adapted for actuating movement of the secondary chain path relative to the secondary chain path.

13. The method of claim 1, further including the steps of:

re-tensioning the primary chain while driving the primary chain; and re-tensioning the secondary chain while driving the secondary chain, re-tensioning of the primary and secondary chains being independent of one another.

14. A trenching head assembly for digging a trench in a hard earth formation, comprising:

a frame having a proximal end adapted for operably connecting to a prime mover positioned on the ground surface and thereby enabling positioning of the trenching head within the trench below the ground surface;

a set of primary sprockets, the set comprising at least one proximal primary sprocket rotatably mounted on the frame and at least one distal primary sprocket rotatably mounted on the frame at a distal end thereof, at least one of the frame and the set of primary sprockets defining a primary chain path;

a primary chain engaged with and circulating around the set of primary sprockets and comprising a plurality of pivotably connected links and a plurality of cutting tools substantially rigidly mounted thereon for disintegrating the earth formation;

a set of secondary sprockets, the set comprising at least one proximal secondary sprocket rotatably mounted on the frame and at least one distal secondary sprocket rotatably mounted on the frame at the distal end thereof, at least one of the frame and the pair of secondary sprockets defining a secondary chain path; and a secondary chain engaged with and circulating around the pair of secondary sprockets and comprising a plurality of pivotably connected links and a plurality of cutting tools substantially rigidly mounted thereon for disintegrating the earth formation, the primary chain being driven at a primary chain linear drive speed in a forward chain direction along the primary chain path, the primary chain being adapted for disintegrating material at a leading edge of the trench and conveying disintegrated material upward and out of the trench, the secondary chain being driven at a secondary chain linear drive speed along the secondary chain path, the secondary chain being adapted for disintegrating material at the leading edge of the trench, at least one of the frame, the set of primary sprockets, and the set of secondary sprockets being adapted so that at least a portion of the secondary chain path extends farther toward the leading edge of the trench than the primary chain path, so that disintegration of material by the secondary chain produces a relief cut in the leading edge of the trench.

15. The trenching head assembly of claim 14, the secondary chain being no wider than about the width of the primary chain.

16. The trenching head assembly of claim 14, the secondary chain being narrower than the width of the primary chain.

17. The trenching head assembly of claim 14, an axis of the distal secondary sprocket being offset from an axis of the distal primary sprocket so that at least a portion of the secondary chain path extends farther toward the leading edge of the trench than the primary chain path.

18. The trenching head assembly of claim 14, an axis of the proximal secondary sprocket being offset from an axis of the proximal primary sprocket and an axis of the distal secondary sprocket being offset from an axis of the distal primary sprocket so that at least a portion of the secondary chain path extends farther toward the leading edge of the trench than the primary chain path.

19. The trenching head assembly of claim 14, the frame defining at least a portion of the secondary chain path extending farther toward the leading edge of the trench than the primary chain path.

20. The trenching head assembly of claim 14, the trenching head assembly further including multiple distal secondary sprockets rotatably mounted near the distal end of the frame for defining a portion of the secondary chain path.

21. The trenching head assembly of claim 14, the secondary chain being driven in a reverse chain direction around the secondary chain path, thereby conveying disintegrated material downward and depositing the disintegrated material within the trench.

22. The trenching head assembly of claim 21, further including:

a crumbing shoe positioned behind the trenching head assembly at a pre-determined depth below the ground surface and adapted for moving in the forward trench-digging direction behind the trenching head assembly, the crumbing shoe being adapted for pushing disintegrated material that projects above a desired support bed surface forward toward the trenching head assembly, the crumbing shoe being adapted for leaving disintegrated material that lies below the desired support bed surface in the trench to form a support bed.

23. The trenching head assembly of claim 22, further including:

a screen positioned between the trenching head assembly and the crumbing shoe and adapted for moving in the forward trench-digging direction behind the trenching head assembly and ahead of the crumbing shoe, the screen being adapted for pushing disintegrated material fragments above a desired mesh size forward toward the trenching head assembly, the screen being adapted for leaving disintegrated material fragments below the desired mesh size in the trench to form a support bed.

24. The trenching head assembly of claim 16, at least one of the frame, the distal primary sprocket, and the distal secondary sprocket being adapted so as to define distal portions of the primary and secondary chain paths substantially tangent to a common substantially horizontal plane, so that disintegration of material by the primary and secondary chains yields a substantially flat bottom surface of the trench.

25. The trenching head assembly of claim 14, further including an actuator for moving the secondary chain path relative to the primary chain path while driving the primary and secondary chains, thereby varying the depth of the relief slot in the leading edge of the trench.

26. The trenching head assembly of claim 14, further including:

a primary re-tensioning mechanism adapted for re-tensioning the primary chain while the primary chain is being driven; and a secondary re-tensioning mechanism adapted for re-tensioning the secondary chain while the secondary chain is being driven, the primary and secondary re-tensioning mechanisms being independent of one another.

* * * * *